US006606060B2

(12) United States Patent
Park

(10) Patent No.: US 6,606,060 B2
(45) Date of Patent: Aug. 12, 2003

(54) CHIP ANTENNA

(75) Inventor: Heung-Soo Park, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 9 days.

(21) Appl. No.: 09/985,554

(22) Filed: Nov. 5, 2001

(65) Prior Publication Data

US 2003/0001785 A1 Jan. 2, 2003

(30) Foreign Application Priority Data

Jul. 2, 2001 (KR) ..... 2001-39337

(51) Int. Cl.[7] ..... H01Q 1/36

(52) U.S. Cl. ..... 343/700 MS; 343/702; 343/895

(58) Field of Search ..... 343/700 MS, 702, 343/895, 783, 722, 787, 788, 741

(56) References Cited

U.S. PATENT DOCUMENTS 6,075,491 A * 6/2000 Dakeya et al. ..... 343/722
6,204,819 B1 * 3/2001 Hayes et al. ..... 343/702
6,320,545 B1 * 11/2001 Nagumo et al. ..... 343/700 MS
6,504,508 B2 * 1/2003 Apostolos ..... 343/700 MS

FOREIGN PATENT DOCUMENTS

JP 10-093320 10/1998

* cited by examiner

*Primary Examiner*—James Clinger
(74) *Attorney, Agent, or Firm*—Lowe Hauptman Gilman & Berner, LLP

(57) ABSTRACT

A chip antenna for use in Bluetooth, in a wireless LAN and in a mobile communication terminal includes an antenna body has an antenna-forming conductor line located therein, and a feeding terminal formed on one end thereof. A PCB (Printed Circuit Board) includes a conductor pattern located thereon so as to be connected to the conductor line of the antenna body. Further, the PCB has a feeding line located on one side of the conductor pattern so as to be connected to the feeding terminal of the antenna body. Still further, the PCB has a fixing terminal located on another side of the conductor pattern so as to be connected to the conductor pattern. Thus, a part of an antenna conductor line is located on the surface of a circuit board, and an antenna body with an antenna formed therein can be installed on the circuit board in a simple manner.

3 Claims, 4 Drawing Sheets

CHIP ANTENNA

FIELD OF THE INVENTION

The present invention relates to a chip antenna which is used in mobile communication terminals, local area networks (LAN) and the like. Particularly, the present invention relates to a chip antenna in which a part of an antenna conductor line is formed on the surface of a circuit board, and an antenna body with an antenna formed therein can be installed on the circuit board in a simple manner, so that the installation of the chip antenna can be rendered easier, and that the thickness of the chip antenna can be reduced.

BACKGROUND OF THE INVENTION

Japanese Laid-open Patent Application No. Hei-10-93320 discloses a chip antenna for use in mobile communication terminals, LAN and the like.

As shown in FIG. 1, this chip antenna includes: a parallelepiped antenna body 10 having a installation face; an internal conductor line 20 formed helically within the antenna body 10 and having a dipping terminal 30 on its end, for being connected to the conductor line 20; and a fixing terminal 40 formed on another end of the antenna body 10, for fixing the chip antenna 50.

Further, as shown in FIG. 2, a capacitance-forming electrode is formed within the chip antenna so as to insert an LC resonance circuit 60 into the parallelepiped antenna body 10.

In the conventional chip antenna 50 constituted as described above, the conductor line 20 is formed within the antenna body 10 to form an antenna. Accordingly, the occupation area of the conductor line 20 is increased, and therefore, the thickness of the chip antenna 50 is increased, this being a serious disadvantage.

Further, in the case where a separate LC resonance circuit 60 is formed within the antenna body 10 of the chip antenna, the capacity of the circuit 60 is limited by the antenna body 10. Further, when the chip antenna 50 is fixed, there has to be provided a fixing terminal 40 which is not related to the conductor line in anyway, this being also a disadvantage.

SUMMARY OF THE INVENTION

The present invention is intended to overcome the above described disadvantages of the conventional techniques.

Therefore it is an object of the present invention to provide a chip antenna in which apart of an antenna conductor line is formed on the surface of a circuit board, and an antenna body with an antenna formed therein can be installed on the circuit board in a simple manner, so that the installation of the chip antenna can be rendered easier, and that the thickness of the chip antenna can be reduced.

It is another object of the present invention to provide a chip antenna in which a separate fixing terminal for fixing the chip antenna to the antenna body is not required, and in forming an LC resonance circuit on a PCB, a chip capacitor and a chip inductor can be easily installed.

In achieving the above objects, the chip antenna according to the present invention includes an antenna body having an antenna-forming conductor line located therein, and a feeding terminal located on one end thereof an antenna-forming conductor pattern located on a face of a PCB (Printed Circuit Board) and arranged to be connected to the conductor line of the antenna body; a feeding line located on one side of the conductor pattern on the face of the PCB and arranged to be connected to the feeding terminal of the antenna body; and a fixing terminal located on another side of the conductor pattern on the face of the PCB and arranged to be connected to the conductor line of the antenna body, wherein the antenna body is mounted on the face of the PCB.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION OF THE PREFERRED EMBODIMENTS

The present invention will be described in detail referring to the attached drawings.

Figure 1:
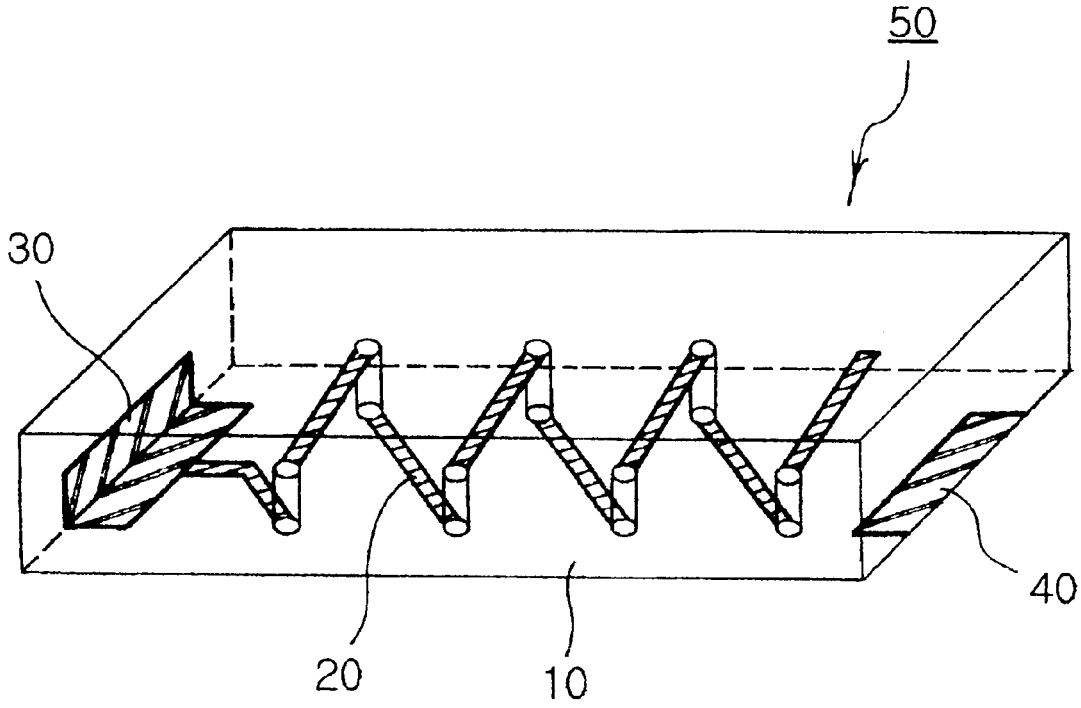
PRIOR ART FIG. 1
FIG. 1 is a perspective view showing the internal structure of a conventional chip antenna.
Figure 2:
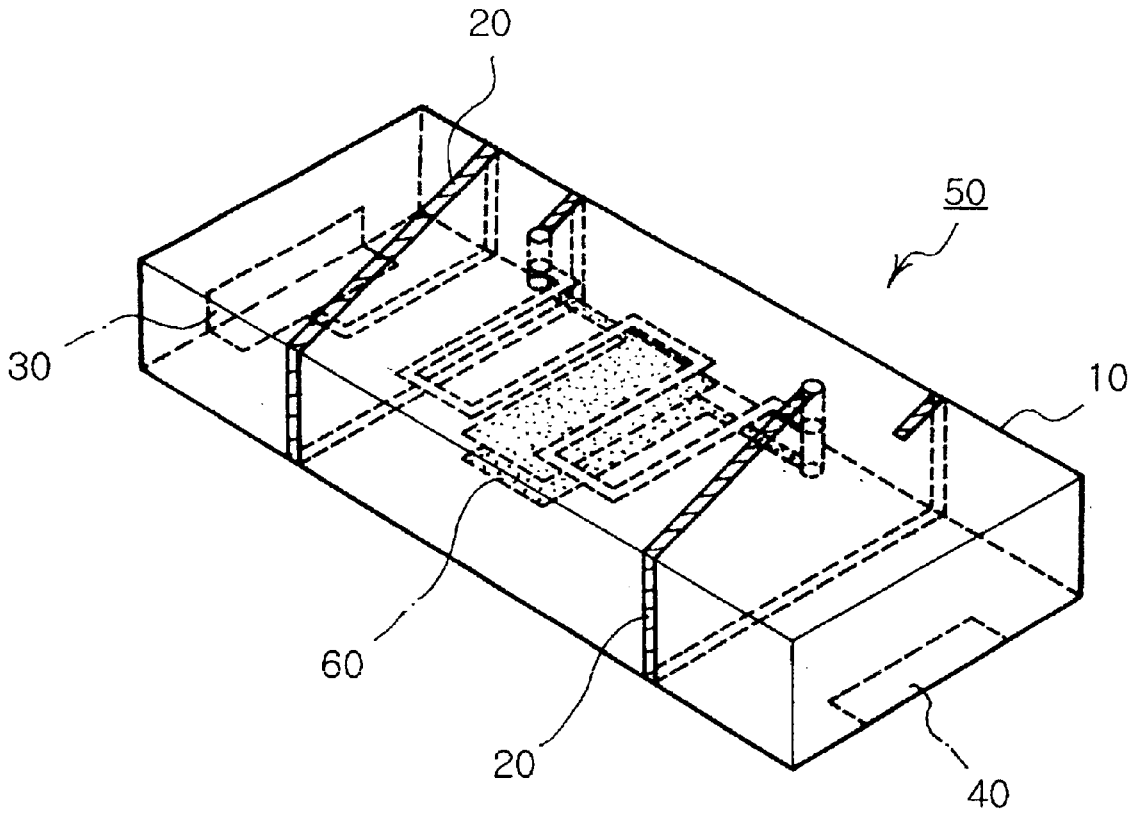
PRIOR ART FIG. 2
FIG. 2 is a perspective view of another conventional chip antenna in which a capacitance-forming electrode is formed.
Figure 3:
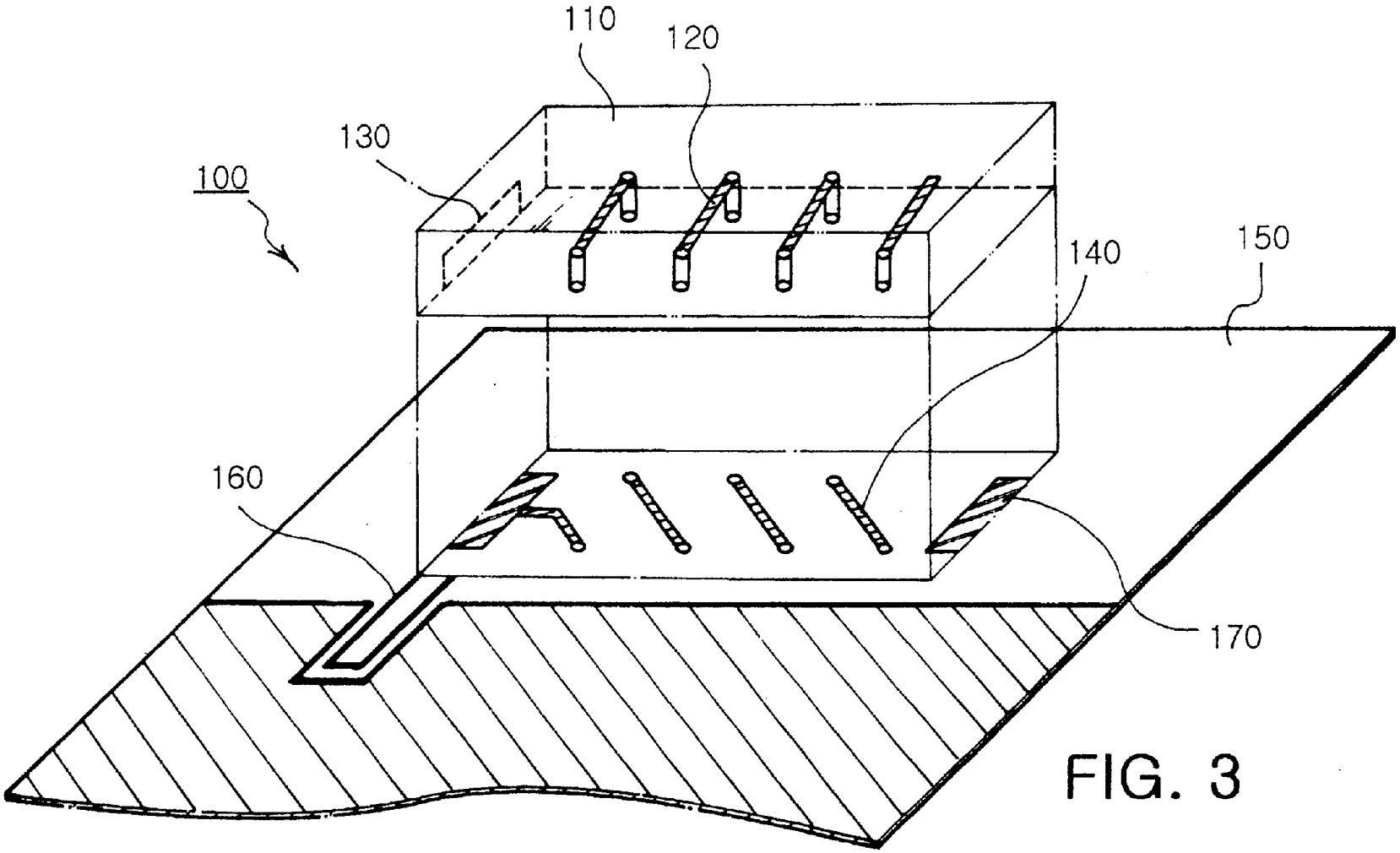
FIG. 3 is a perspective view of a PCB and the chip antenna in accordance with an embodiment of the present invention, the chip antenna being installed on the PCB.

FIG. 3 is a perspective view of a circuit board and the chip antenna in accordance with an embodiment of the present invention, the chip antenna being installed on the circuit board.

A conductor line 120 for forming an antenna is formed within a parallelepiped antenna body 110, and a feeding terminal 130 is formed on one end of the antenna body 110.

A PCB 150 is provided with a conductor pattern 140 which is printed thereon so as to be connected to the conductor line 120 of the antenna body 110. Further, the PCB is provided with a feeding line 160 which is formed at a side of the conductor pattern 140 so as to be connected to the feeding terminal 130 of the antenna body 110.

Further, the PCB 150 is provided with a fixing terminal 170 which is formed at another side of the conductor pattern 140 so as to be connected to the conductor pattern 140, thereby completing a chip antenna 100.

Under this condition, the conductor pattern 140, the feeding line 160 and the fixing terminal 170, which are formed on the PCB 150, are not provided with a ground pattern.

Now the present invention constituted as above will be described as to its action and effects.

As shown in FIG. 3, the conductor line 120 for forming an antenna is formed within the parallelepiped antenna body 110, and the feeding terminal 130 is formed on one end of the antenna body 110. Thus the conductor line 120 and the feeding terminal 130 are formed, and they serve as parts of the antenna.

Further, the PCB 150 is provided with the conductor pattern 140 which is printed thereon so as to be connected to the conductor line 120 of the antenna body 110. Further, the PCB is provided with the feeding line 160 which is formed at a side of the conductor pattern 140 so as to be connected to the feeding terminal 130 of the antenna body 110.

Thus when installing the parallelepiped antenna body 110 of the chip antenna onto the PCB 150, the conductor line 120 of the antenna body 110 is connected to the conductor pattern 140 of the PCB 150, while the feeding terminal 130 is connected to the feeding line 160 of the PCB 150, thereby forming an antenna.

Further, the PCB 150 is provided with the fixing terminal 170 which is formed at another side of the conductor pattern 140 so as to be connected to the conductor pattern 140, thereby completing the chip antenna 100.

Under this condition, the conductor pattern 140, the feeding line 160 and the fixing terminal 170, which are formed on the PCB 150, are not provided with a ground pattern. In place of the ground pattern, the conductor line is formed, and therefore, the thickness of the antenna body 110 can be markedly reduced, thereby forming the chip antenna 100.

Figure 4:
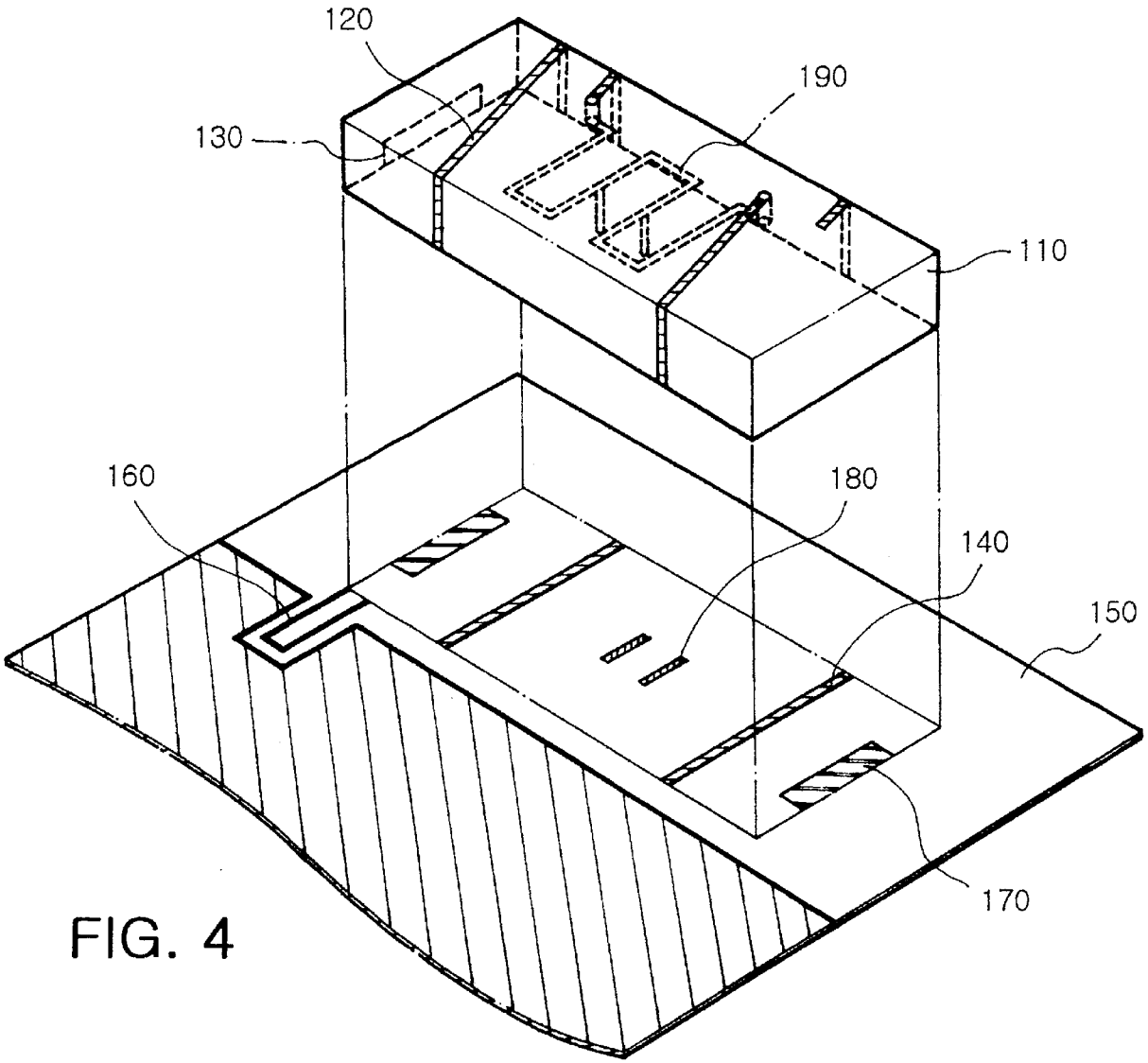
FIG. 4 is a perspective view showing another embodiment of the present invention, in which a chip capacitor is to be installed.

FIG. 4 is a perspective view showing another embodiment of the present invention, in which a chip capacitor or a chip inductor is to be installed.

Within an antenna body 110 which is same that of the first embodiment, there is formed a circuit pattern 190 which is connected to a chip capacitor-installing electrode 180 or to a chip inductor so as to be connected to the conductor line 120. The chip capacitor or the chip inductor (not illustrated) is installed on the PCB 150 in advance before the installation of the antenna body 110.

Accordingly, when installing the antenna body 110 onto the PCB 150, the chip capacitor-installing electrode 180 or the like which has been installed on the PCB 150 can be connected to the circuit pattern 190. Further, the desired values of C and L can be arbitrarily obtained, and therefore, the design freedom in designing the chip antenna can be improved.

According to the present invention as described above, a part of an antenna conductor line is formed on the surface of a circuit board, and an antenna body with an antenna formed therein can be installed on the circuit board in a simple manner, so that the installation of the chip antenna can be rendered easier, and that the thickness of the chip antenna can be reduced. Further, a separate fixing terminal for fixing the chip antenna to the antenna body is not required, and in forming an LC resonance circuit on a PCB, a chip capacitor and a chip inductor can be easily installed.

In the above, the present invention was esc e on the specific preferred embodiments and the attached drawings, but it should be apparent to those of ordinary skill in the art that various changes and modifications can be added without departing from the spirit and scope of the present invention, which will be defined in the appended claims.

What is claimed is:

1. A chip antenna comprising:

an antenna body having an antenna-forming conductor line located therein, and a feeding terminal located on one end thereof;

an antenna-forming conductor pattern located on a face of a PCB (Printed Circuit Board) and arranged to be connected to the conductor line of the antenna body;

a feeding line located on one side of the conductor pattern on the face of the PCB and arranged to be connected to the feeding terminal of the antenna body; and a fixing terminal located on another side of the conductor pattern on the face of the PCB and arranged to be connected to the conductor line of the antenna body, wherein the antenna body is mounted on the face of the PCB.

2. The chip antenna as claimed in claim 1, wherein the conductor pattern, the feeding line and the fixing terminal of the PCB are not provided with a ground pattern.

3. The chip antenna as claimed in claim 1, the antenna body further comprising a circuit pattern arranged to be connected to at least one of a chip capacitor-installing electrode or to a chip inductor, wherein the at least one of the chip capacitor and the chip inductor is located on the PCB.

* * * * *